US008537026B2

(12) United States Patent
Chen et al.

(10) Patent No.: US 8,537,026 B2
(45) Date of Patent: Sep. 17, 2013

(54) COMPUTING DEVICE WITH COLOR ORGAN

(75) Inventors: Chun-Sheng Chen, New Taipei (TW); Hua Zou, Shenzhen (CN); Feng-Long He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 128 days.

(21) Appl. No.: 13/308,562

(22) Filed: Dec. 1, 2011

(65) Prior Publication Data

US 2012/0326622 A1 Dec. 27, 2012

(30) Foreign Application Priority Data

Jun. 24, 2011 (CN) ..... 2011 1 0173026

(51) Int. Cl.
*G08B 5/00* (2006.01)
*A63J 5/10* (2006.01)

(52) U.S. Cl.
USPC ..... 340/815.46; 84/464 R

(58) Field of Classification Search
USPC ..... 84/464 R; 340/815.46
See application file for complete search history.

(56) References Cited

U.S. PATENT DOCUMENTS

| | | | | |
|---|---|---|---|---|
| 3,806,919 | A * | 4/1974 | Comey | 340/815.46 |
| 3,885,490 | A * | 5/1975 | Gullickson | 84/470 R |
| 4,353,008 | A * | 10/1982 | Dorfman | 315/114 |
| 4,440,059 | A * | 4/1984 | Hunter | 84/464 R |
| 2007/0209497 | A1 * | 9/2007 | Robertson | 84/464 R |

* cited by examiner

*Primary Examiner* — Thienvu Tran
(74) *Attorney, Agent, or Firm* — Altis Law Group, Inc.

(57) ABSTRACT

A computing device includes an audio signal processing unit, a light module, and driving circuits. The audio signal processing unit decompresses digital audio data into an audio signal. The driving circuit drives the light module to light according to the audio signal, in such a manner that the intensity/brightness of the light module corresponds to amplitude of the audio signal in real-time.

6 Claims, 3 Drawing Sheets

COMPUTING DEVICE WITH COLOR ORGAN

BACKGROUND

1. Technical Field

The present disclosure relates to computing devices, and particularly, to a computing device with a color organ.

2. Description of Related Art

Computing devices can play music having sound effects. However, listeners of the music may wish to experience the music not only through sound, but also accompaniment with other effects, such as, visible effects. One such visible effect can be accomplished through the use of color organs which convert music into rhythmic light effects, pulsating to the beat of the music. However, there is still room for improvement in the art.

Therefore, it is desirable to provide an electronic device, which can overcome the above-mentioned problems.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the present disclosure will now be described in detail with reference to the drawings.

Figure 1:
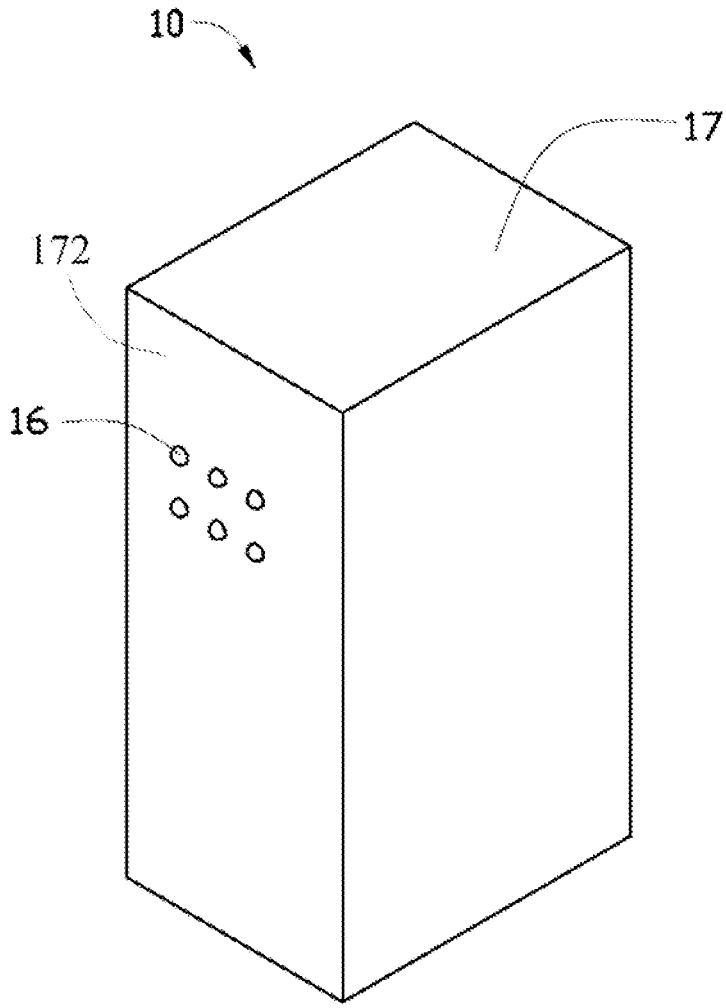
FIG. 1 is an isometric schematic view of an electronic device, according to an exemplary embodiment.
Figure 2:
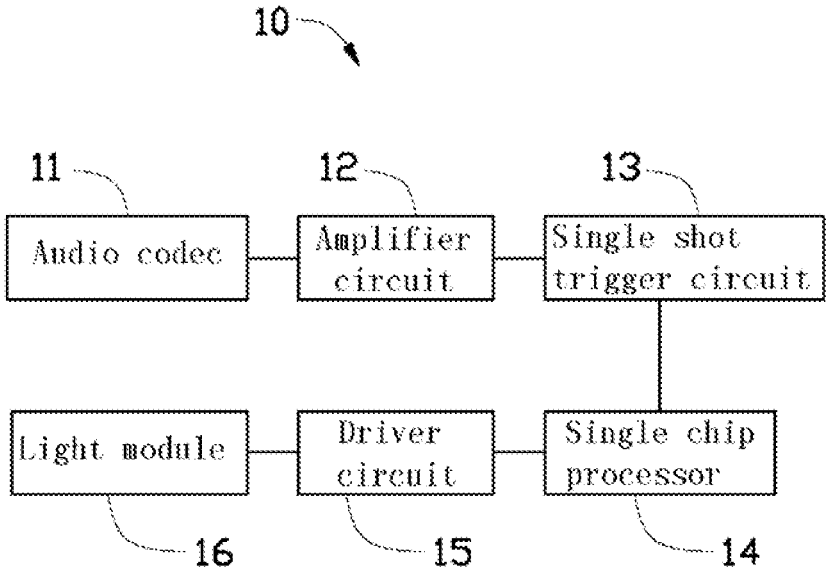
FIG. 2 is a functional diagram of the electronic device of FIG. 1, according to the embodiment.

Referring to FIGS. 1 and 2, a computing device 10, according to an embodiment, includes an audio signal processing unit 11, an amplifier circuit 12, a single shot trigger circuit 13, a single chip processor 14, a driver circuit 15, a light module 16, and a case 17. The audio signal processing unit 11, the amplifier circuit 12, a single shot trigger circuit 13, and the driver circuit 15 can be received in the case 17 while the light module 16 can be mounted on an outer surface 172 of the case 17.

The audio signal processing unit 11 can be a microchip which is also received in the case 17 and configured for compressing or decompressing digital audio data into an audio signal. In other embodiments, the computing device 10 includes a processor (not shown) and the audio signal processing unit 11 can be a software program implementing an algorithm on the processor to realize the compressing or decompressing of the digital audio data. The computing device 10 can be connected to an external storage device in which the digital audio data can be stored and the audio signal processing unit 11 reads the digital audio data from the external storage device. Also, the computing device 10 can further includes an internal storage device for storing the digital audio data and the audio signal processing unit 11 reading the digital audio data from the internal storage device.

Figure 3:
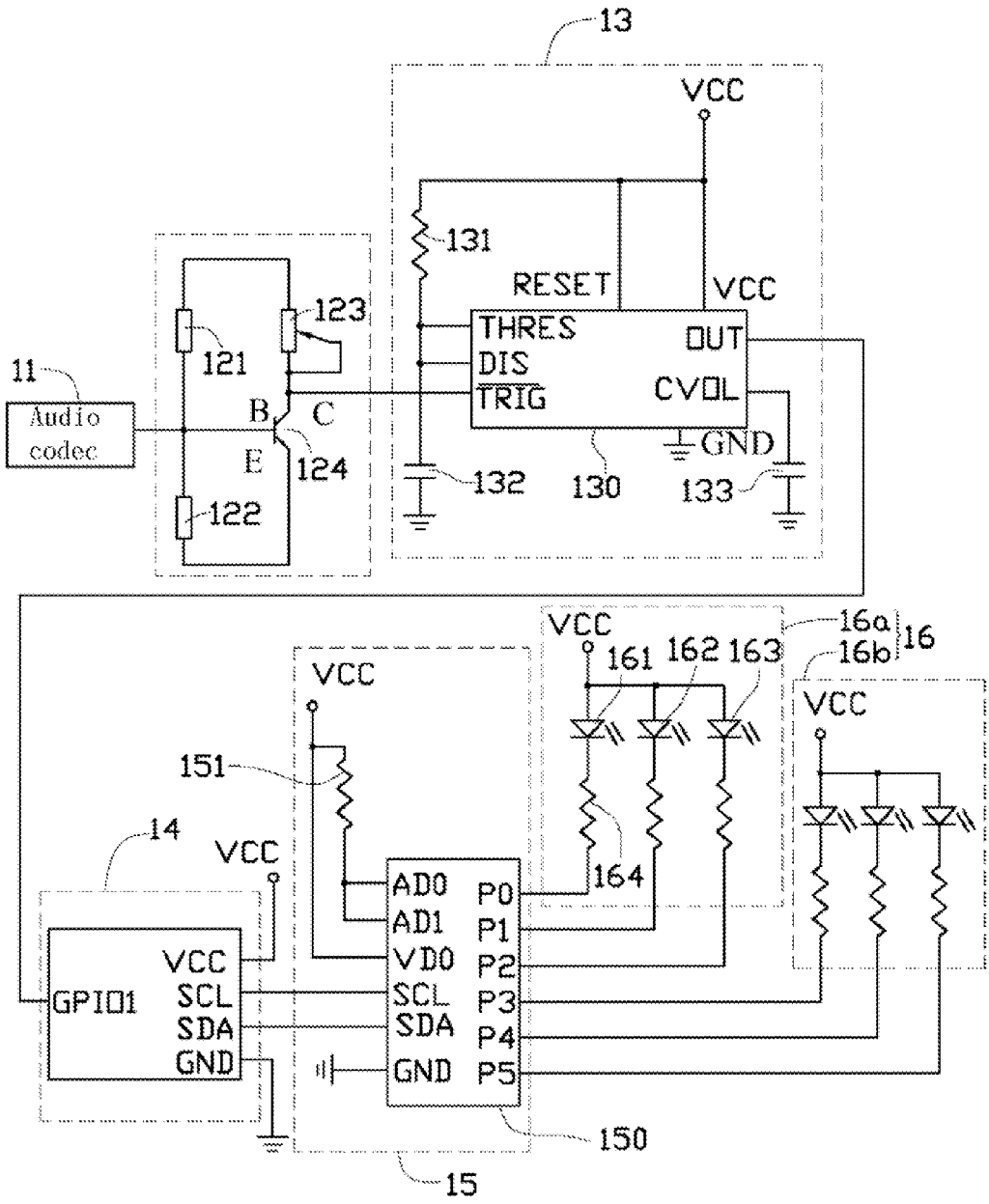
FIG. 3 is a circuit diagram of the electronic device of FIG. 1, according to the embodiment.

Also referring to FIG. 3, the amplifier circuit 12 can be connected to the audio signal processing unit 11 and amplifies an amplitude of the audio signal. In this embodiment, the amplifier circuit 12 includes a first resistor 121, a second resistor 122, a variable resistor 123, and a transistor 124. The transistor 124 can be a bipolar junction transistor (BJT) and includes a base B, a collector C, and an emitter E. The base B can be directly connected to the audio signal processing unit 11 for receiving the audio signal, the collector C can be connected to the audio signal processing unit 11 through the first resistor 121 and the variable resistor 123, and the emitter E can be connected to the audio signal processing unit 11 through the second resistor 122. The amplifier circuit 12 outputs an amplified audio signal via the collector C and an amplifying factor of the amplifier circuit 12 can be adjusted by changing a resistance of the variable resistor 124.

The single shot trigger circuit 13 can be connected to the amplifier circuit 12 and generates a pulse width modulation (PWM) signal according to the amplified audio signal. In this embodiment, the single shot trigger circuit 13 includes a 555 timer chip 130, a third resistor 131, a first capacitor 132, and a second capacitor 133. The 555 timer chip 130 has the following pins listed in Table 1.

TABLE 1

| Pin Label | Purpose |
|---|---|
| GND | Ground, low level (0 V) |
| $\overline{\text{TRIG}}$ | OUT rises, and interval starts, when this input falls below ⅓ VCC. |
| OUT | This output is driven to VCC or GND. |
| RESET | A timing interval may be interrupted by driving this input to GND. |
| CVOL | "Control" access to the internal voltage divider (by default, ⅔ VCC). |
| THRES | The interval ends when the voltage at THRES is greater than at CVOL. |
| DIS | Open collector output; may discharge a capacitor between intervals. |
| VCC | Positive supply voltage is usually between 3 and 15 V. |

The pins VCC and RESET can be directly connected to a direct current (DC) voltage source VCC. The pin VCC can be also grounded through the third resistor 131 and the first capacitor 132. The pins THRES and DIS can be grounded through the first capacitor 132. The pin CVOL can be grounded through the second capacitor 133. The pin GND can be grounded. The pin TRIG can be connected to the collector C of the transistor 124 for receiving the amplified audio signal. The pin OUT can be configured for outputting the PWM signal. The PWM signal rises when the amplified audio signal falls below ⅓ VCC (can be other thresholds in other embodiments) and otherwise falls.

The single chip processor 14 can be connected to the single shot trigger circuit 13 and generates a driving signal according to the PWM signal. In one embodiment, the single chip processor 14 can be an 89C051 single chip and includes a power pin VCC, a ground pin GND, a general purpose input output (GPIO) pin GPIO1, a serial clock line (SCL) pin SCL, and a serial data line (SDA) pin SDA. The power pin VCC can be connected to the DC voltage source VCC, the ground pin GND can be grounded, the GPIO pin GPIO1 can be connected to the pin OUT of the 555 timer chip 130 for receiving the PWM signal. The pins SCL and SDA can be two bidirectional open-drain line interfaces of an inter-integrated circuit ($I^2C$) bus and output the driving signal.

The driver circuit 15 can be connected to the single chip processor 14 and generates driving voltages of the light module 16. The driver circuit 15 includes a light emitting diode (LED) driver chip 150 and a fourth resistor 151. The LED driver chip 150 can be SAA1064 chip and includes a power pin VD0, a ground pin GND, two slave address input pins AD0, AD1, an SCL pin SCL, an SDA pin SDA, and six segment output pins P0-P5. The power pin VD 0 can be directly connected to the DC voltage source VCC, the ground pin GND can be grounded, the slave address input pins AD0, AD1 can be connected to the DC voltage source VCC through the fourth resistor 151, the SCL pin SCL can be connected to the SCL pin SCL of the single chip processor 14, and the SDA pin SDA can be connected to the SDA pin SDA of the single chip processor 14. The segment output pints P0-P6 output the driving voltages.

The light module 16 can be connected to the driver circuit 15 and lights according to the driving voltages to reflect the amplitude of the audio signal in real-time. In this embodiment, the light module 16 includes two units 16*a*, 16*b*, each of which includes a red LED 161, a green LED 162, a blue LED 163, and three fifth resistors 164. Anodes of the LEDs 161, 162, 163 can be connected to the segment output pins P0-P5 respectively through the fifth resistor 164. The LEDs 161, 162, 163 can be driven to light and the intensity/brightness can be proportional to the amplitude of the audio signal.

As such, the computing device 10 can play the digital audio data (e.g., music) where the loudness of the digital audio data can be represented with light effects.

It will be understood that the above particular embodiments are shown and described by way of illustration only. The principles and the features of the present disclosure may be employed in various and numerous embodiment thereof without departing from the scope of the disclosure as claimed. The above-described embodiments illustrate the possible scope of the disclosure but do not restrict the scope of the disclosure.

What is claimed is:

1. A computing device, comprising:

a case;

an audio signal processing unit configured for compressing or decompressing a digital audio data into an audio signal;

an amplifier circuit connected to the audio signal processing unit and is configured for amplifying an amplitude of the audio signal;

a single shot trigger circuit connected to the amplifier circuit and configured for generating a pulse width modulation (PWM) signal according to the amplified audio signal;

a single chip processor connected to the single shot trigger circuit and configured for generating a driving signal according to the PWM signal; and a driver circuit connected to the single chip processor and configured for generating driving voltages; and a light module mounted on an outside surface of the case and connected to the driver circuit, the driver circuit being configured for driving the light module to light using the driving voltages such that a brightness of the light module varies with the amplitude of the audio signal in real-time.

2. The computing device of claim 1, wherein the amplifier circuit comprises a first resistor, a second resistor, a variable resistor, and a transistor, the transistor is a bipolar junction transistor and comprises a base, a collector, and an emitter, the base is directly connected to the audio signal processing unit for receiving the audio signal, the collector is connected to the audio signal processing unit through the first resistor and the variable resistor, and the emitter is connected to the audio signal processing unit through the second resistor, the amplifier circuit outputs the amplified audio signal via the collector.

3. The computing device of claim 1, wherein the single shot trigger circuit comprises a 555 timer chip, a third resistor, a first capacitor, and a second capacitor, the 555 timer chip comprises a trigger pin connected to the amplifier circuit for receiving the amplified audio signal and an output pin for outputting the PWM signal, and the PWM signal rises when the amplified audio signal falls below a predetermined threshold and otherwise falls.

4. The computing device of claim 1, wherein the single chip processor comprises a general purpose input output (GPIO) pin connected to the single shot trigger circuit for receiving the PWM signal and output pins for outputting the driving signal.

5. The computing device of claim 1, wherein the driver circuit comprises a light emitting diode (LED) driver chip, the LED driver chip includes input pins connected with the single chip processor for receiving the driving signal and output pints for outputting the driving voltages.

6. The computing device of claim 1, wherein the light module comprises LEDs.

* * * * *